US005371910A

United States Patent [19]

Sebor

[11] Patent Number: 5,371,910

[45] Date of Patent: Dec. 13, 1994

[54] SLIDING OSCILLATOR SEAL FOR SUBMERSIBLE SUCTION CLEANER

[76] Inventor: Pavel Sebor, 45 Highcliff Way, Northcliff Extension 12, Johannesburg, Transvall, South Africa

[21] Appl. No.: 880,665

[22] Filed: May 11, 1992

[30] Foreign Application Priority Data

Feb. 28, 1992 [ZA] South Africa ..... 92/1502

[51] Int. Cl.[5] ..... E04H 3/20

[52] U.S. Cl. ..... 15/1.7; 251/175; 92/125; 137/527; 137/527.8

[58] Field of Search ..... 15/1.7, 404, 419; 137/110, 112, 527.8, 527.6, 527; 251/175, 176, 59, 85; 92/125

[56] References Cited

U.S. PATENT DOCUMENTS

| | | | |
|---|---|---|---|
| 1,591,903 | 7/1926 | White | 251/175 |
| 1,860,619 | 5/1932 | Pfau | 251/175 |
| 2,108,183 | 2/1938 | Sjoberg | 251/175 |
| 3,023,741 | 3/1962 | O'Connor | 92/125 |
| 4,023,227 | 5/1977 | Chauvier | 15/1.7 |
| 4,208,752 | 6/1980 | Hofmann | 15/1.7 |
| 4,351,077 | 9/1982 | Hofmann | 15/1.7 |

FOREIGN PATENT DOCUMENTS

| | | | |
|---|---|---|---|
| 557312 | 5/1957 | France | 251/175 |

*Primary Examiner*—David A. Scherbel
*Assistant Examiner*—Gary K. Graham
*Attorney, Agent, or Firm*—Allen, Dyer, Doppelt, Franjola & Milbrath

[57] ABSTRACT

A submersible suction cleaner includes a chamber, an oscillator pivotably mounted within the chamber for movement to and fro with a gap between an edge of the oscillator and a wall of the chamber through which water containing grit flows during operation. The chamber wall or the oscillator has a slidable, retractable seal operable to open when grit lodges between the oscillator and the chamber wall to thereby open the gap and allow the passage of grit therethrough.

6 Claims, 2 Drawing Sheets

SLIDING OSCILLATOR SEAL FOR SUBMERSIBLE SUCTION CLEANER

BACKGROUND OF INVENTION

1. Field of Invention

This invention relates to an oscillator used in self-propelled submersible suction cleaners, particularly swimming pool suction cleaners. The term "self-propelled" herein means that the suction cleaner is not manually propelled but includes means operated by the flow of water through the suction head to cause propulsion of the device.

2. Description of Background Art

The most common form of propulsion mechanism comprises an oscillator disposed within the flow path through the suction head of the cleaner, which flow is caused by coupling of the suction head to a filter pump for the pool by suitable hose means. The oscillator is so shaped that flow therepast causes it to move to and fro on its pivot, the oscillator engaging the housing of the suction head at the extremity of its pivotal movement on each side, the impact causing the head to advance stepwise along a surface to be swept.

In order for the oscillator to operate efficiently it must be located in a suction chamber so that the oscillator pivots in close proximity to a wall of the chamber. This is necessary so that the bulk of flow past the oscillator moves along surfaces designed to provide the to and fro movement of the oscillator.

If flow is dissipated around the oscillator along non-functional surfaces the operation of the oscillator become inefficient and the advance motion of the suction head sluggish. The oscillator can, of course, fit neatly into the suction chamber of the head to provide for efficient action thereof but a swimming pool floor often has grit particles which are drawn into the suction cleaner and such grit is liable to lodge between the oscillator and the closely spaced chamber wall causing the oscillator to lose efficiency through friction or even to stick.

SUMMARY OF THE INVENTION

It is an object of the invention to provide seal means for an oscillator which minimises this difficulty.

According to the invention a self-propelled submersible suction cleaner includes a head having an oscillator pivotally mounted for movement to and fro within a suction chamber so that the edges of the oscillator suitably seal against the suction chamber walls, the oscillator and at least one suction chamber wall being separable under the action of grit lodging between the oscillator and the chamber wall thereby to open a gap between the oscillator and the wall and allow the grit to pass therethrough.

In a preferred arrangement according to the invention, the oscillator operates with a gap between at least one edge of the oscillator and the chamber wall, the oscillator having seal means extending between the edge of the oscillator and the suction chamber wall to close the gap, and seal means being slidably mounted on the oscillator so as to be able to retract from the chamber wall under the action of grit lodging between the seal and the chamber wall thereby to open the gap between the oscillator and the wall and allow the grit to pass therethrough.

In this arrangement the oscillator preferable has a slot along either edge thereof and an elongated seal member is located in each slot, the seal members being able to slide outwardly from its slot to engage the chamber wall or to be forced inwardly into the slot to open the gap between that edge of the oscillator and the chamber wall.

As an alternative to the sliding seal the oscillator itself may be split, with one part engaging in tongue fashion within a groove in the other.

In yet a further alternative one or both walls of the suction chamber may be slidably mounted on the housing so as to be able to move away from the oscillator should grit intervene between them.

BRIEF DESCRIPTION OF DRAWINGS

In order to illustrate the invention three examples thereof are described below with reference to the accompanying drawings in which.

DETAILED DESCRIPTION OF PREFERRED EMBODIMENT

Figure 1:
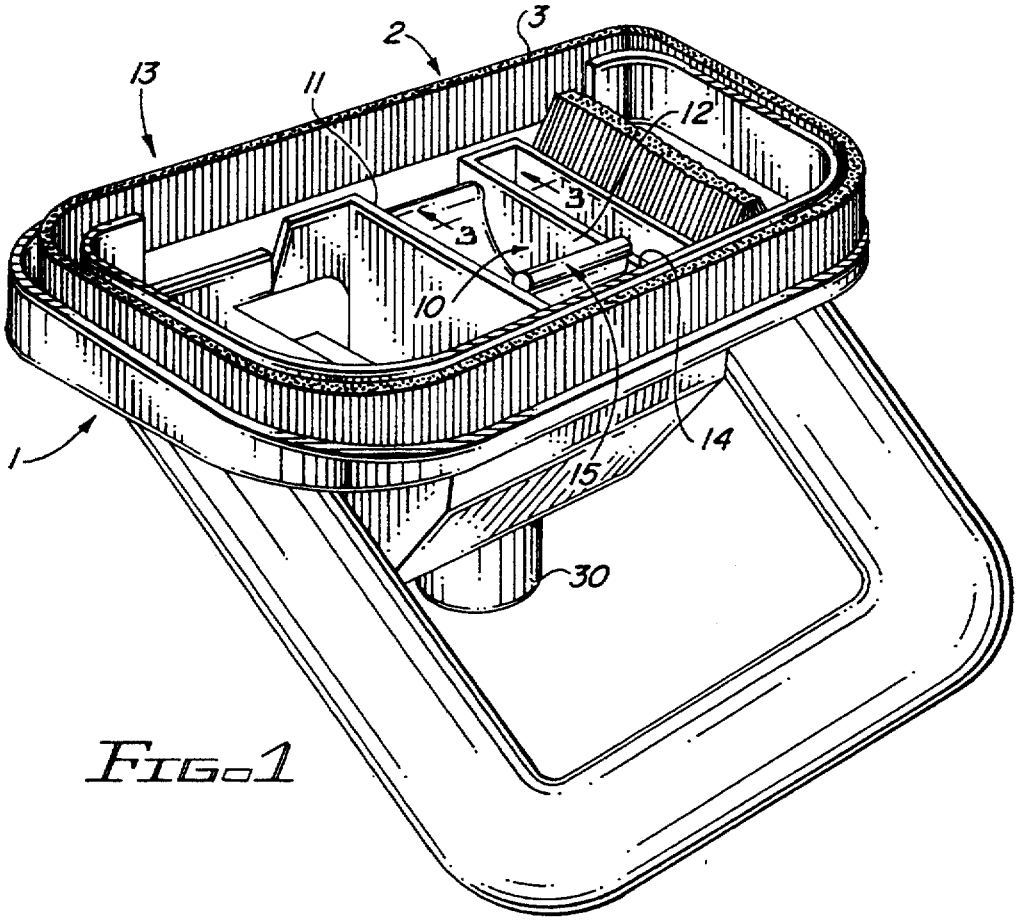
FIG. 1 is a perspective view of the lower side of a suction cleaner head according to the invention.
Figure 2:
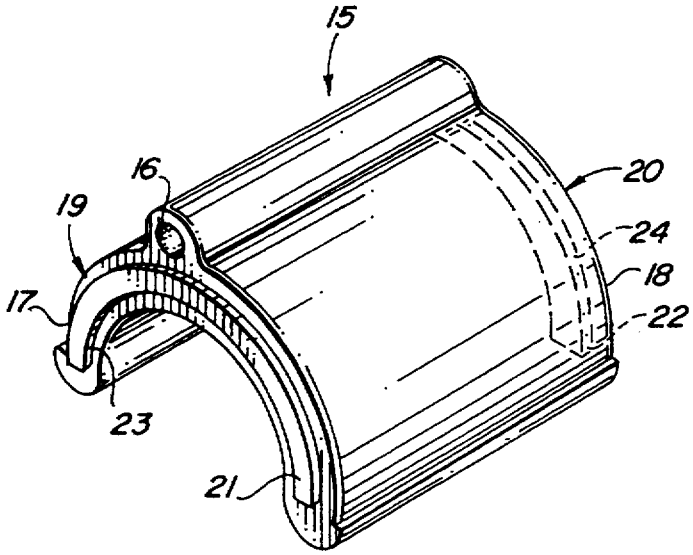
FIG. 2 is a perspective view of an oscillator forming part of the suction cleaner head and incorporating a sliding seal according to the invention.
Figure 3:
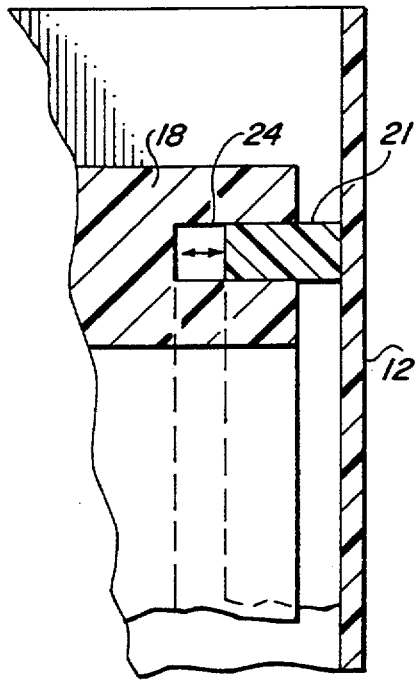
FIG. 3 is a section taken on the line III—III of FIG. 1.

Referring to FIGS. 1 to 3 of the drawings, a self-propelled suction cleaner head comprises a housing 1 having a mouth 2 along which bristles 3 are disposed so that the head rests on the bristles in its operative position.

The head incorporates a suction chamber 10 within housing 1 which suction chamber is comprised of side walls 11 and 12 and end walls 13 and 14 defined by the housing itself.

An oscillator 15 is pivotally mounted within the suction chamber on a hinge pin (not shown) extending through a boss 16 on the oscillator, the hinge pin being journalled on the side walls 11 and 12, the pin and boss defining a pivot axis between the side walls.

A connector 30 is provided on the housing 1 for a suction hose (not shown) used to connect the suction head to the filter pump of a swimming pool. Coupling the suction head to the filter pump causes flow into the suction chamber 10 via the mouth of the housing and the flow impinges the arcuate sides 17 and 18 of the oscillator causing the latter to swing to and fro on its hinge pin impacting against the housing on either side of oscillator 15 thereby causing the head to advance in stepwise fashion.

It will be appreciated that the efficiency of the operation of the oscillator depends on the strength of flow over the arcuate sides 17 and 18. If this flow is dissipated around the edges 19 and 20 of the oscillator between the latter and the walls 11 and 12, the strength of the flow over the surfaces 17 and 18 will be diminished with a consequent drop in the efficiency of the propelling action of the oscillator.

In order to prevent such dissipation of the flow energy, the arrangement may be one in which the oscillator is neatly located between the side walls 11 and 12 so that little flow is dissipated. In this event, however, grit drawn into the suction chamber 10 is liable to lodge between the oscillator and side walls 11 and 12 thereby causing loss of efficiency of the oscillator through friction, or the oscillator may even stick.

In accordance with the present invention the oscillator and suction chamber are designed so that the edges 19 and 20 are suitably spaced respectively by gaps 25 and 26 from the side walls 11 and 12 of the suction chamber to enable grit to pass easily therethrough. Retractable sealing means 21 and 22 are provided at each edge 19 and 20 of the oscillator 15 to seal the gap 25 and 26 between the edges 19 and 20 of the oscillator and the side walls 11 and 12 respectively of the suction chamber.

The sealing means 21 and 22 comprise arcuate strips each located in a slot 23 and 24 in the respective edges 19 and 20 of the oscillator, the width of the strips being equal to the depth of the slots.

Thus when the suction head is coupled to the filter pump and water is caused to flow around the oscillator 15 in the suction chamber, the strips 21 and 22 are drawn outwardly from the slots 23 and 24 in a direction parallel with the pivot axis into sealing engagement with the walls 11 and 12 of the suction chamber. Under normal operation of the oscillator the engagement between the sealing strips 21 and 22 and the walls 11 and 12 causes minimal friction and little impairment of the efficiency of the oscillator. In the event that grit finds its way between the sealing strips 21 and 22 and the walls 11 and 12, the sealing strips are simply forced to retract into the slots 23 and 24 allowing the grit easily to pass through the suction chamber and into the filter.

Figure 4:
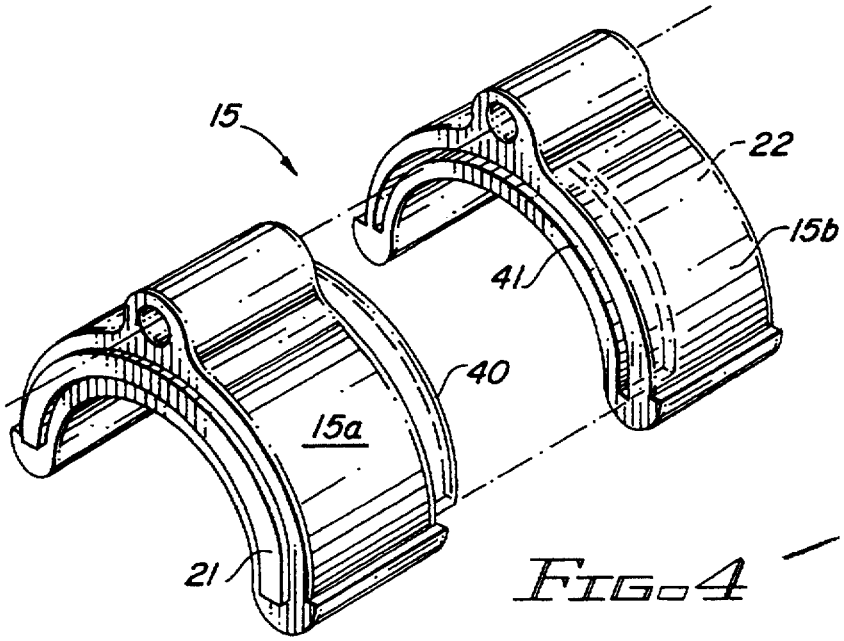
FIG. 4 is a perspective view of an oscillator providing an alternative form of sliding seal according to the invention.

Referring now to FIG. 4 it will be seen that in an alternative arrangement the oscillator 15 is split into two sections 15*a* and 15*b*. Oscillator section 15*a* has a tongue 40 which is slidable into and out of groove 41 in the oscillator section 15*b*.

In this case the sealing means 21 and 22 on the outer edges of the oscillator are fixed. In the event that grit finds its way between sealing means 21 and 22 and walls 11 and 12 of the suction chamber, the tongue 40 of oscillator section 15*a* is simply forced to retract into groove 41 of oscillator section 15*b* thereby opening a gap between sealing strips 21 and 22 and walls 11 and 12 of the suction chamber and allowing the grit easily to pass through the suction chamber into the filter.

Figure 5:
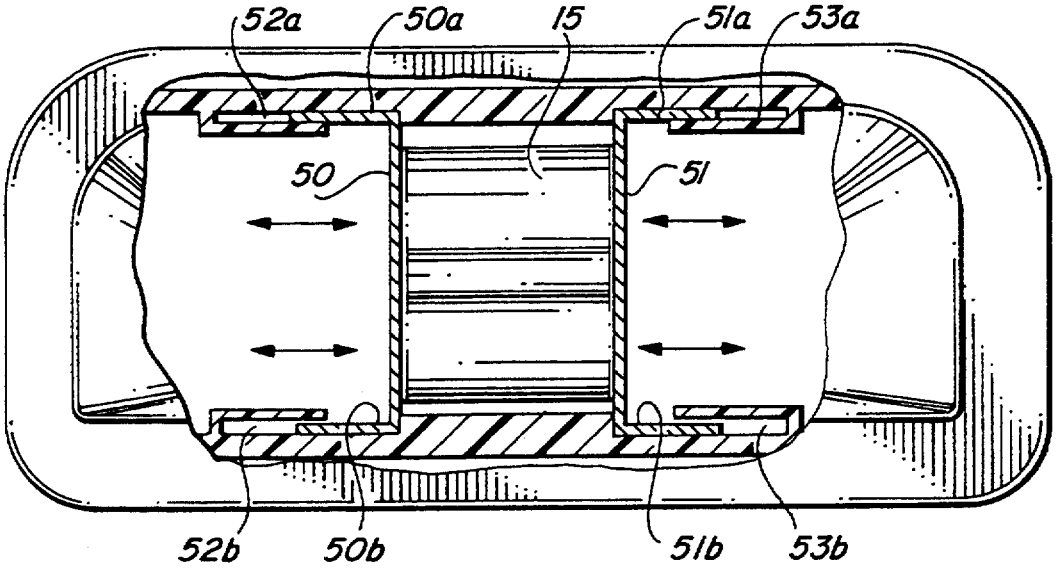
FIG. 5 is a plan view partly in section of yet a further alternative form of sliding seal.

Referring now to FIG. 5 a second alternative is provided in the form of a suction chamber having side walls 50 and 51 mounted so as to allow end sections 50*a* and 50*b* and 51*a* and 51*b* to be slidable into and out of guide tracks 52*a*, 52*b* and 53*a*, 53*b*, respectively.

Under normal conditions the side walls are drawn against the oscillator 15 by the suction created within the suction chamber. However, should grit enter between the oscillator 15 and the walls 50 and 51 the latter simply retract into the guide tracks 52*a*, 52*b* and 53*a*, 53*b* allowing the grit to pass through the suction chamber into the filter.

What is claimed is:

1. A submersible suction cleaner comprising a housing including a suction chamber, an oscillator pivotably mounted within the suction chamber for movement to and fro with a gap between an edge of the oscillator and a wall of the chamber through which gap water containing grit flows during operation of the suction chamber, the oscillator having sealing means mounted on the edge of the oscillator for extending across the gap in contact with the chamber wall, the oscillator formed of at least two sections, with one section having a tongue and the other section having a groove with the tongue and groove aligned with each other for mating during operation of the oscillator to permit retraction of the sealing means away from the chamber wall when grit lodges between the sealing means and the chamber wall to thereby open the gap and allow the grit to pass therethrough.

2. A submersible suction cleaner for swimming pools comprising:

a housing including a suction chamber having an opening defined by opposing walls, through which opening water flows continuously during operation of the cleaner;

oscillator means having opposing ends, the oscillator means pivotably mounted in the opening on a pivot axis extending between the walls for continuous oscillatory movement to and fro within the opening responsive to the flow of water across the ends of the oscillator;

first sealing means slidably fitted on a first side of the oscillator and slidable outwardly in a direction generally parallel with the pivot axis into engagement with a first one of the walls; and second sealing means slidably fitted on a second side of the oscillator opposing the first side and slidable outwardly in a direction generally parallel with the pivot axis into engagement with the second one of the opposing walls.

3. The submersible suction cleaner recited in claim 2 wherein the oscillator means has an arcuate cross-sectional shape transverse to the pivot axis and wherein each of the first and second sealing means has a corresponding arcuate shape.

4. The submersible suction cleaner recited in claim 3 wherein each of the opposing ends is at an extremity of the arcuate oscillator means.

5. The submersible suction cleaner recited in claim 2 wherein each sealing means is fitted within a slot in the corresponding side of the oscillator means, each slot having a shape conforming to a cross-sectional shape transverse to the pivot axis of the oscillator means.

6. The submersible suction cleaner recited in claim 2 further comprising a gap between each wall and the adjacent side of the oscillator means, and wherein each of the sealing means is dimensioned to slide outwardly across the corresponding gap.

* * * * *